US011243481B2

(12) United States Patent
Ezure et al.

(10) Patent No.: US 11,243,481 B2
(45) Date of Patent: Feb. 8, 2022

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Kazuaki Ezure, Osaka (JP); Tomofumi Shimizu, Osaka (JP); Hayase Yamamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/866,116

(22) Filed: May 4, 2020

(65) Prior Publication Data

US 2020/0356017 A1 Nov. 12, 2020

(30) Foreign Application Priority Data

May 9, 2019 (JP) ..... JP2019-089109

(51) Int. Cl.
*G03G 5/05* (2006.01)
*G03G 5/06* (2006.01)
(Continued)

(52) U.S. Cl.
CPC ..... *G03G 5/056* (2013.01); *G03G 5/0609* (2013.01); *G03G 5/0618* (2013.01);
(Continued)

(58) Field of Classification Search
CPC .... G03G 5/0564; G03G 5/056; G03G 5/0614; G03G 5/06142; G03G 5/06145; G03G 5/06147
See application file for complete search history.

(56) References Cited

U.S. PATENT DOCUMENTS

2004/0101771 A1* 5/2004 Azuma ..... G03G 5/05 430/58.85
2004/0126685 A1* 7/2004 Horgan ..... G03G 5/0614 430/58.3

(Continued)

FOREIGN PATENT DOCUMENTS

JP 2017-181690 A 10/2017

*Primary Examiner* — Peter L Vajda
(74) *Attorney, Agent, or Firm* — Studebaker & Brackett PC

(57) ABSTRACT

An electrophotographic photosensitive member includes a conductive substrate and a photosensitive layer of a single layer. The photosensitive layer contains a charge generating material, a binder resin, a hole transport material, and an electron transport material. The binder resin includes a polyester resin. The polyester resin includes a first repeating unit represented by general formula (1) shown below and a second repeating unit represented by general formula (2) shown below.

(1)

(2)

A content percentage of the polyester resin in the photosensitive layer is at least 0.3% by mass and no greater than 7.0% by mass.

13 Claims, 2 Drawing Sheets

(51) Int. Cl.
*G03G 15/00* (2006.01)
*G03G 21/18* (2006.01)

(52) U.S. Cl.
CPC ..... *G03G 5/06142* (2020.05); *G03G 5/06144* (2020.05); *G03G 15/75* (2013.01); *G03G 21/1814* (2013.01)

(56) References Cited

U.S. PATENT DOCUMENTS

2006/0216620 A1* 9/2006 Fu ..... G03G 5/0596
430/59.6
2016/0363886 A1* 12/2016 Yoshihara ..... G03G 15/75
2018/0299799 A1* 10/2018 Kubo ..... C08G 63/916

* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2019-89109, filed on May 9, 2019. The contents of this application are incorporated herein by reference in their entirety.

BACKGROUND

The present disclosure relates to an electrophotographic photosensitive member, a process cartridge, and an image forming apparatus.

An electrophotographic photosensitive member is used as an image bearing member in an electrographic image forming apparatus (for example, a printer or a multifunction peripheral). The electrophotographic photosensitive member includes a photosensitive layer. Examples of the electrophotographic photosensitive member include a single-layer electrophotographic photosensitive member and a multi-layer electrophotographic photosensitive member. The single-layer electrophotographic photosensitive member includes a photosensitive layer of a single layer having a charge generating function and a charge transporting function. The multi-layer electrophotographic photosensitive member includes a photosensitive layer including a charge generating layer having a charge generating function and a charge transport layer having a charge transporting function.

An example of a resin that is added to the photosensitive layer is a polyester resin. An example of the electrophotographic photosensitive member includes a photosensitive layer containing a polyester resin including a repeating unit represented by chemical formula (Z) shown below.

(Z)

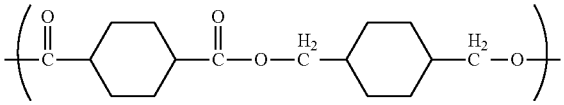

SUMMARY

An electrophotographic photosensitive member according to an aspect of the present disclosure is an electrophotographic photosensitive member including a conductive substrate and a photosensitive layer of a single layer. The photosensitive layer contains a charge generating material, a binder resin, a hole transport material, and an electron transport material. The binder resin includes a polyester resin. The polyester resin includes a first repeating unit represented by general formula (1) shown below and a second repeating unit represented by general formula (2) shown below. A content percentage of the polyester resin in the photosensitive layer is at least 0.3% by mass and no greater than 7.0% by mass.

(1)

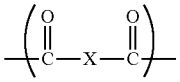

(2)

In the general formula (1), X represents a phenylene group optionally substituted by a first substituent. The first substituent is a phenyl group, an alkyl group having a carbon number of at least 1 and no greater than 8, or an alkoxy group having a carbon number of at least 1 and no greater than 8. In general formula (2), Y represents a divalent aliphatic hydrocarbon group having a carbon number of at least 1 and no greater than 8 and optionally substituted by a second substituent. The second substituent is a phenyl group or an alkoxy group having a carbon number of at least 1 and no greater than 8.

A process cartridge according to an aspect of the present disclosure includes the electrophotographic photosensitive member described above.

An image forming apparatus according to an aspect of the present disclosure includes: an image bearing member; a charger that positively charges a surface of the image bearing member; a light exposure section that exposes the charged surface of the image forming apparatus to light to form an electrostatic latent image on the surface of the image bearing member; a developing section that develops the electrostatic latent image into a toner image; and a transfer section that transfers the toner image from the image bearing member to a transfer target. The image bearing member is the electrophotographic photosensitive member described above. The transfer section transfers the toner image from the image bearing member to the transfer target while bringing the transfer target into contact with the surface of the image bearing member.

DETAILED DESCRIPTION

Figure 1:
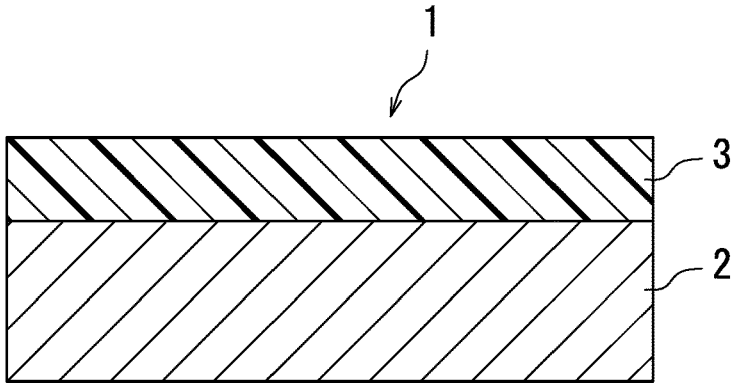
FIG. 1 is a partial cross-sectional view of an example of an electrophotographic photosensitive member according to a first embodiment of the present disclosure.

The following describes embodiments of the present disclosure in detail. However, the present disclosure is not in any way limited by the embodiments described below and appropriate variations may be made in practice within the intended scope of the present disclosure. Although explanation is omitted as appropriate in order to avoid repetition, such omission does not limit the essence of the present disclosure. In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Unless otherwise stated, only one of materials indicated below may be used independently or two or more of the materials indicated below may be used in combination.

Hereinafter, an alkyl group having a carbon number of at least 1 and no greater than 8, an alkyl group having a carbon number of at least 1 and no greater than 6, an alkyl group having a carbon number of at least 1 and no greater than 4, an alkyl group having a carbon number of at least 3 and no greater than 6, an alkoxy group having a carbon number of at least 1 and no greater than 8, and a halogen atom each refer to the following unless otherwise stated.

An alkyl group having a carbon number of at least 1 and no greater than 8, an alkyl group having a carbon number of at least 1 and no greater than 6, an alkyl group having a carbon number of at least 1 and no greater than 4, and an alkyl group having a carbon number of at least 3 and no greater than 6 as used herein each refer to an unsubstituted straight chain or branched chain alkyl group. Examples of the alkyl group having a carbon number of at least 1 and no greater than 8 include a methyl group, an ethyl group, a propyl group, an isopropyl group, an n-butyl group, an s-butyl group, a t-butyl group, a pentyl group, an isopentyl group, a neopentyl group, a hexyl group, a heptyl group, and an octyl group. Out of the chemical groups listed as the examples of the alkyl group having a carbon number of at least 1 and no greater than 8, chemical groups having a carbon number of at least 1 and no greater than 6, chemical groups having a carbon number of at least 1 and no greater than 4, and chemical groups having a carbon number of at least 3 and no greater than 6 are respectively examples of the alkyl group having a carbon number of at least 1 and no greater than 6, examples of the alkyl group having a carbon number of at least 1 and no greater than 4, and examples of the alkyl group having a carbon number of at least 3 and no greater than 6.

An alkoxy group having a carbon number of at least 1 and no greater than 8 as used herein is an unsubstituted straight chain or branched chain alkoxy group. Examples of the alkoxy group having a carbon number of at least 1 and no greater than 8 include a methoxy group, an ethoxy group, an n-propoxy group, an isopropoxy group, an n-butoxy group, an s-butoxy group, a t-butoxy group, a pentyloxy group, an isopentyloxy group, a neopentyloxy group, a hexyloxy group, a heptyloxy group, and an octyloxy group.

Examples of the halogen atom include a fluorine atom, a chlorine atom, a bromine atom, and an iodine atom.

First Embodiment: Electrophotographic Photosensitive Member

An electrophotographic photosensitive member (also referred to below as a photosensitive member) according to a first embodiment of the present disclosure includes a conductive substrate and a photosensitive layer of a single layer. The photosensitive layer contains a charge generating material, a binder resin, a hole transport material, and an electron transport material. The binder resin includes a polyester resin (also referred to below as a polyester resin (PE)). The polyester resin (PE) includes a first repeating unit represented by general formula (1) shown below and a second repeating unit represented by general formula (2) shown below. A content percentage of the polyester resin (PE) in the photosensitive layer is at least 0.3% by mass and no greater than 7.0% by mass. In the following description, the first and second repeating units may be referred to as repeating units (1) and (2), respectively.

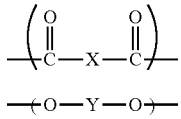

(1)

(2)

In general formula (1), X represents a phenylene group optionally substituted by a first substituent. The first substituent is a phenyl group, an alkyl group having a carbon number of at least 1 and no greater than 8, or an alkoxy group having a carbon number of at least 1 and no greater than 8. In general formula (2), Y represents a divalent aliphatic hydrocarbon group having a carbon number of at least 1 and no greater than 8 and optionally substituted by a second substituent. The second substituent is a phenyl group or an alkoxy group having a carbon number of at least 1 and no greater than 8.

As a result of having the above features, the photosensitive member according to the present disclosure has high photosensitive layer withstand voltage under high-temperature conditions and excellent sensitivity. However, use of a known photosensitive member under high-temperature and high-humidity conditions may cause local dielectric breakdown in a photosensitive layer of the photosensitive member. Such local dielectric breakdown locally impairs chargeability of the photosensitive layer to serve a factor of dot-shaped image defects.

The present inventor found that addition of a specific amount of the polyester resin (PE) to a photosensitive layer can significantly improve photosensitive layer withstand voltage under high-temperature conditions although a specific reason could not be determined. In passing, no significant difference in withstand voltage under normal-temperature conditions was observed between a photosensitive layer containing the polyester resin (PE) and a photosensitive layer not containing the polyester resin (PE). The present inventor further found that addition of an excessive amount of the polyester resin (PE) to a photosensitive layer impairs sensitivity of a photosensitive member including the photosensitive layer. In light of the above knowledge, the present inventor completed the photosensitive member of the present disclosure. That is, the photosensitive member according to the present disclosure, which includes a photosensitive layer containing the polyester resin (PE), has high photosensitive layer withstand voltage under high-temperature conditions. Accordingly, use of the photosensitive member of the present disclosure can prevent dot-shaped image defects as described above even under high-temperature and high-humidity conditions. Furthermore, as a result of the content percentage of the polyester resin (PE) in the photosensitive layer being no greater than 7.0% by mass, the photosensitive member according to the present disclosure is excellent in sensitivity.

Figure 2:
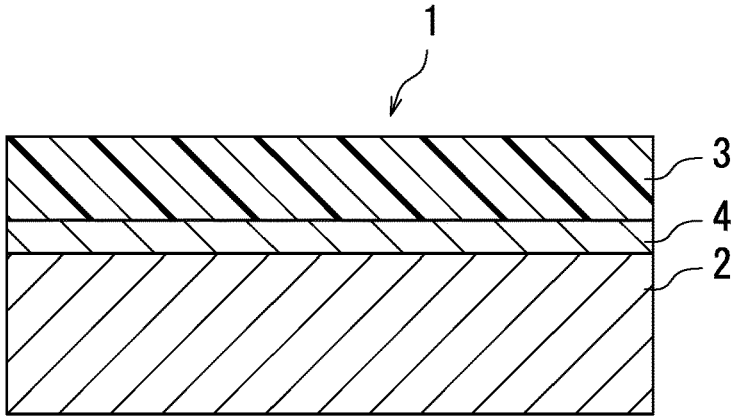
FIG. 2 is a partial cross-sectional view of an example of the electrophotographic photosensitive member according to the first embodiment of the present disclosure.
Figure 3:
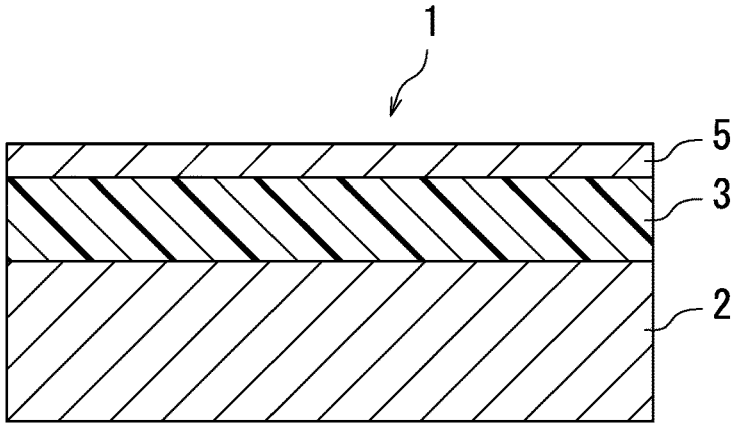
FIG. 3 is a partial cross-sectional view of an example of the electrophotographic photosensitive member according to the first embodiment of the present disclosure.

The following describes examples of structure of the photosensitive member with reference to FIGS. 1 to 3. FIGS. 1. to 3 each are a cross-sectional view of an example of the photosensitive member (also referred to below as a "photosensitive member 1").

As illustrated in FIG. 1, the photosensitive member 1 includes for example a conductive substrate 2 and a photosensitive layer 3. The photosensitive layer 3 is a single layer (one layer). That is, the photosensitive member 1 is a single-layer electrophotographic photosensitive member including the photosensitive layer 3 of a single layer.

As illustrated in FIG. 2, the photosensitive member 1 may include a conductive substrate 2, a photosensitive layer 3, and an intermediate layer 4 (undercoat layer). The intermediate layer 4 is disposed between the conductive substrate 2 and the photosensitive layer 3. As illustrated in FIG. 1, the photosensitive layer 3 may be disposed directly on the conductive substrate 2. Alternatively, the photosensitive layer 3 may be disposed on the conductive substrate 2 with the intermediate layer 4 therebetween as illustrated in FIG. 2. The intermediate layer 4 may include one layer or a plurality of layers.

As illustrated in FIG. 3, the photosensitive member 1 may include a conductive substrate 2, a photosensitive layer 3, and a protective layer 5. The protective layer 5 is disposed on the photosensitive layer 3. The protective layer 5 may include one layer or a plurality of layers. The examples of the structure of the photosensitive member 1 have been described so far with reference to FIGS. 1 to 3. Each element (the conductive substrate, the photosensitive layer, the intermediate layer, and the protective layer) of the photosensitive member will be described below in detail.

[Conductive Substrate]

No specific limitations are placed on the conductive substrate other than being a conductive substrate that can be used as a conductive substrate of a photosensitive member. At least a surface portion of the conductive substrate is formed from a conductive material. The conductive substrate may for example be a conductive substrate formed from a conductive material. Alternatively, the conductive substrate may for example be a conductive substrate having a coat of a conductive material.

Examples of the conductive material include aluminum, iron, copper, tin, platinum, silver, vanadium, molybdenum, chromium, cadmium, titanium, nickel, palladium, indium, and alloys containing any of the materials listed above (for example, an aluminum alloy, stainless steel, and brass). Out of the conductive materials listed above, aluminum or an aluminum alloy is preferable in terms of favorable charge mobility from the photosensitive layer to the conductive substrate.

The conductive substrate is not limited to being any particular shape, and the shape thereof can be selected appropriately according to the structure of an image forming apparatus in which the conductive substrate is to be used. The conductive substrate is for example in a sheet shape or a drum shape. The thickness of the conductive substrate is selected appropriately according to the shape of the conductive substrate.

[Photosensitive Layer]

The photosensitive layer contains a charge generating material, a binder resin, a hole transport material, and an electron transport material. The binder resin includes a polyester resin (PE). The binder resin preferably further includes a later-described polyarylate resin. The photosensitive layer may further contain an additive or a binder resin other than the polyester resin (PE) and the polyarylate resin (also referred to below as an "additional binder resin") as necessary. No particular limitations are placed on thickness of the photosensitive layer so long as the thickness thereof is sufficient to enable the photosensitive layer to function as a photosensitive layer. The photosensitive layer has a thickness of preferably at least 5 μm and no greater than 100 μm, and more preferably at least 10 μm and no greater than 50 μm.

(Charge Generating Material)

Examples of the charge generating material contained in the photosensitive layer include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (for example, selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridon-based pigments.

Examples of the phthalocyanine-based pigments include metal-free phthalocyanine and metal phthalocyanine. Examples of the metal phthalocyanine include titanyl phthalocyanine, hydroxygallium phthalocyanine, and chlorogallium phthalocyanine. Titanyl phthalocyanine is represented by chemical formula (CGM-1) shown below.

(CGM1)

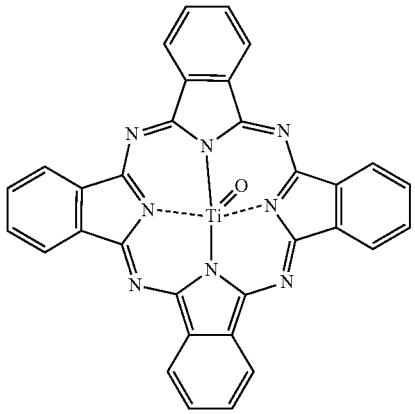

The phthalocyanine-based pigments may be crystalline or non-crystalline. An example of crystalline metal-free phthalocyanine is metal-free phthalocyanine having a crystal structure of X form (also referred to below as "X-form metal-free phthalocyanine"). Examples of crystalline titanyl phthalocyanine include titanyl phthalocyanine having a crystal structure of α form, β form, or Y form (also referred to below as α-form, β-form, and Y-form titanyl phthalocyanine, respectively).

For example, in a digital optical image forming apparatus (for example, a laser beam printer or facsimile machine that uses a light source such as a semiconductor laser), a photosensitive member that is sensitive in a range wavelength of at least 700 nm is preferably used. In terms of high quantum yield in a wavelength range of at least 700 nm, the charge generating material is preferably a phthalocyanine-based pigment, more preferably metal-free phthalocyanine or titanyl phthalocyanine, further preferably X-form metal-free phthalocyanine or Y-form titanyl phthalocyanine, and particularly preferably Y-form titanyl phthalocyanine.

For a photosensitive member in an image forming apparatus that uses a short-wavelength laser light source (for example, a laser light source having a wavelength of at least 350 nm and no greater than 550 nm), the charge generating material is preferably an anthanthrone-based pigment.

The charge generating material is contained in the photosensitive layer in an amount of preferably at least 0.1 parts by mass and no greater than 50 parts by mass relative to 100 par of the binder resin, more preferably at least 0.5 parts by mass and no greater than 30 parts by mass, and further preferably at least 0.5 parts by mass and no greater than 4.5 parts by mass.

(Binder Resin)

(Polyester Resin (PE))

The polyester resin (PE) includes the repeating unit (1) and the repeating unit (2). In the polyester resin (PE), multiple repeating units (1) and multiple repeating units (2) are for example arranged in an alternating sequence. In this case, preferably, the amount of the repeating unit (1) and the amount of the repeating unit (2) are substantially the same as each other in the polyester resin (PE). Specifically, a ratio p (amount of repeating unit (2)/amount of repeating unit (1)) of the amount of the repeating unit (2) to the amount of the repeating unit (1) in the polyester resin (PE) is preferably at least 49/51 and no greater than 51/49.

Note that the amount of each repeating unit in the polyester resin (PE) is an average value of values obtained from the entirety (plural molecular chains) of the polyester resin (PE) contained in the photosensitive layer rather than a value obtained from one molecular chain. The ratio p can be calculated from a $^{1}$H-NMR spectrum of the polyester resin (PE) plotted using a proton nuclear magnetic resonance spectrometer. The same is applied to each amount of later-described repeating units in the polyarylate resin (PA).

(Repeating Unit (1))

The repeating unit (1) is represented by general formula (1). In general formula (1), an example of the first substituent in X is an alkyl group having a carbon number of at least 1 and no greater than 4. The number of the first substituents in X is preferably no less than 0 and no greater than 2, and more preferably 0. A phenylene group represented by X is preferably an unsubstituted phenylene group. The repeating unit (1) is preferably a repeating unit represented by either of chemical formulas (1-1) and (1-2) shown below (also referred to below as repeating units (1-1) and (1-2), respectively).

(1-1)

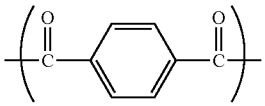

(1-2)

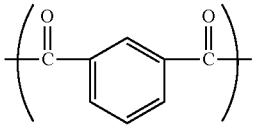

(Repeating Unit (2))

The repeating unit (2) is represented by general formula (2). In general formula (2), examples of the divalent aliphatic hydrocarbon group having a carbon number of at least 1 and no greater than 8 that is represented by Y include a divalent saturated hydrocarbon group having a carbon number of at least 1 and no greater than 8, a divalent unsaturated hydrocarbon group having a carbon number of at least 2 and no greater than 8, a divalent alicyclic hydrocarbon group having a carbon number of at least 3 and no greater than 8, and a divalent aromatic hydrocarbon group having a carbon number of at least 6 and no greater than 8. Out of the chemical groups listed above, a divalent saturated hydrocarbon group having a carbon number of at least 1 and no greater than 8 is preferable. Examples of the divalent saturated hydrocarbon group having a carbon number of at least 1 and no greater than 8 include an alkanediyl group having a carbon number of at least 1 and no greater than 8, an alkenediyl group having a carbon number of at least 2 and no greater than 8, and an alkynediyl group having a carbon number of at least 2 and no greater than 8. Out of the chemical groups listed above, an alkanediyl group having a carbon number of at least 1 and no greater than 8 is preferable. Examples of the alkanediyl group having a carbon number of at least 1 and no greater than 8 include chemical groups listed as the examples of the alkyl group having a carbon number of at least 1 and no greater than 8 from which one hydrogen atom has been removed. Specific examples of the alkanediyl group having a carbon number of at least 1 and no greater than 8 include an ethylene group, a propanediyl group, a butanediyl group, and a pentanediyl group.

In general formula (2), an example of the second substituent in Y is a phenyl group. The number of the second substituents in Y is preferably no less than 0 and no greater than 2, and more preferably 0.

The repeating unit (2) is preferably a repeating unit represented by any of chemical formulas (2-1), (2-2), (2-3), and (2-4) shown below (also referred to below as repeating units (2-1), (2-2), (2-3), and (2-4), respectively).

(2-1)

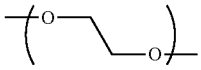

(2-2)

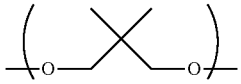

(2-3)

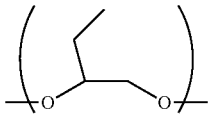

(2-4)

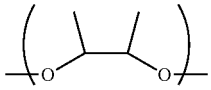

The polyester resin (PE) may further include an additional repeating unit other than the repeating units (1) and (2). An example of the additional repeating unit is a repeating unit having a cycloalkane structure. A ratio of a total amount of the repeating units (1) and (2) to a total amount of repeating units included in the polyester resin (PE) is preferably at least 70%, more preferably at least 95%, and further preferably 100%.

Examples of a preferable combination of the repeating units (1) and (2) included in the polyester resin (PE) include:

a first combination of the repeating units (1-1), (1-2), (2-1), and (2-2);

a second combination of the repeating units (1-1), (1-2), (2-1), and (2-3); and a third combination of the repeating units (1-1), (1-2), (2-1), and (2-4). Out of the combinations listed above, the first combination is more preferable.

That is, the polyester resin (PE) further preferably includes the repeating unit (1-1), the repeating unit (1-2), the repeating unit (2-1), and the repeating unit (2-2).

The polyester resin (PE) is preferably a resin represented by any of chemical formulas (PE-a), (PE-b), and (PE-c) shown below (also referred to below as polyester resins (PE-a), (PE-b), and (PE-c), respectively).

(PE-a)

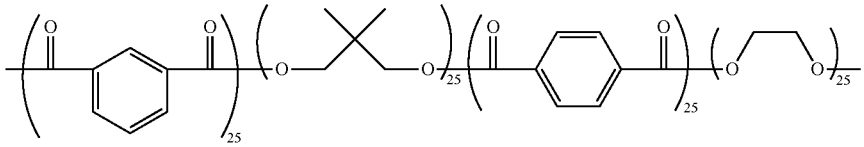

(PE-b)

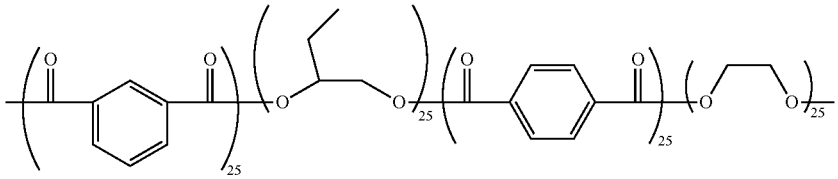

(PE-c)

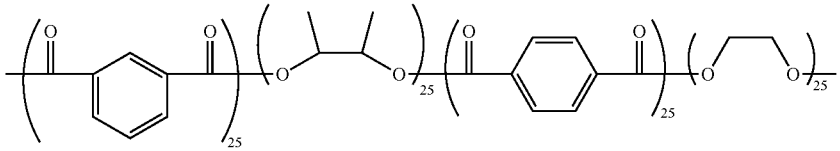

The polyester resin (PE) has a viscosity average molecular weight of preferably at least 5,000 and no greater than 100,000, and more preferably at least 15,000 and no greater than 30,000.

A content percentage of the polyester resin (PE) in the photosensitive layer is preferably at least 0.3% by mass and no greater than 7.0% by mass, more preferably at least 1.0% by mass and no greater than 3.0% by mass, and further preferably at least 1.0% by mass and no greater than 1.6% by mass. As a result of the content percentage of the polyester resin (PE) being set to at least 0.3% by mass, photosensitive layer withstand voltage under high-temperature conditions can be increased. As a result of the content percentage of the polyester resin (PE) being set to no greater than 7.0% by mass, the photosensitive member can have improved sensitivity.

The following describes an example of a synthesis method of the polyester resin (PE). First, a diester compound (I) represented by general formula (I) shown below and a diol compound (II) represented by general formula (II) shown below are prepared. In the following general formulas (I) and (II), X and Y are the same as defined for X and Y in the general formulas (1) and (2), respectively. In the following general formula (I), chemical groups $R^X$ each represent, independently of one another, an alkyl group having a carbon number of at least 1 and no greater than 4. Preferably, $R^X$ represents a methyl group.

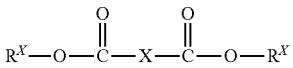

(I)

(II)

Subsequently, transesterification is caused between the diester compound (I) and the diol compound (II), thereby obtaining the polyester resin (PE). In transesterification, for example, an organic titanium compound (for example, tetrabutyl orthotitanate) is preferably added as a catalyst to a reaction system. An amount of the catalyst is for example at least 0.005 parts by mass and no greater than 0.100 parts by mass relative to 100 parts by mass of a total amount of the diester compound (I) and the diol compound (II). Transesterification is preferably carried out under conditions of a reaction temperature of 200° C. or higher and 280° C. or lower and a reaction time of 30 minutes or longer and 3 hours or shorter. Any alcohol compounds generated in transesterification (for example, methanol) are preferably removed out from the reaction system.

The following describes a specific example of a synthesis method of the polyester resin (PE) through transesterification. First, a diester compound (I) (for example, dimethyl terephthalate or dimethyl isophthalate), a diol compound (II) (for example, ethylene glycol), and tetrabutyl orthotitanate are added into a reaction vessel equipped with a thermometer, a stirrer, and a cooling tube for distillation. A molar ratio between the diester compound (I) and the diol compound (II) is set to approximately 1:1. The amount of tetrabutyl orthotitanate is set to 0.028 parts by mass relative to 100 parts by mass of a total amount of the diester compound (I) and the diol compound (II). The contents of the reaction vessel are gradually heated over 4 hours to increase its temperature to 200° C. Through temperature increase, transesterification starts. In the following, a time when the temperature of the contents of the reaction vessel reaches 200° C. is defined as a start of the reaction. Note that any alcohol compounds generated in transesterification are removed out from the reaction system by distillation. After a start of transesterification, pressure reduction is performed over 30 minutes to adjust an air pressure in the reaction vessel to 500 Pa (initial polymerization). After pressure reduction, the contents of the reaction vessel is heated to 250° C., followed by adjustment of the air pressure in the reaction vessel to 130 Pa by additional pressure reduction. Thereafter, polymerization is allowed to proceed for 60 minutes. Through the above process, the polyester resin (PE) is obtained.

However, the polyester resin (PE) may be synthesized by another synthesis method instead of the above-described transesterification. An example of the other synthesis method is a dehydration condensation reaction. In a case where the polyester resin (PE) is synthesized through a dehydration condensation reaction, a dicarboxylic acid compound (III) represented by general formula (III) shown below or a derivative thereof (for example, a halide or an anhydride) and a diol compound (II) or a derivative thereof (for example, diacetate) can be used as raw materials. In general formula (III) shown below, X is the same as defined in general formula (1) above.

(III)

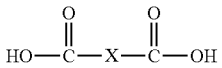

Note that in synthesis of the polyester resin (PE), an additional component (for example, another monomer or an additive) other than the diester compound (I), the diol compound (II), the dicarboxylic acid (III), and the catalyst may be further added to the reaction system as necessary.

(Polyarylate Resin (PA))

The photosensitive layer preferably further contains a polyarylate resin. The polyarylate resin is preferably a resin including a third repeating unit represented by general formula (3) shown below and a fourth repeating unit represented by general formula (4) shown below (also referred to below as a polyarylate resin (PA)). In the following, the third and fourth repeating units may be referred to as repeating units (3) and (4), respectively.

(3)

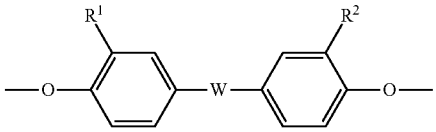

(4)

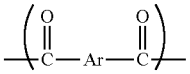

In general formula (3), $R^1$ and $R^2$ each represent, independently of one another, a hydrogen atom or a methyl group. W represents a divalent group represented by general formula (W1), (W2), or (W3) shown below. In general formula (4), Ar represents a divalent group represented by chemical formula (Ar-1), (Ar-2), or (Ar-3) shown below.

(W1)

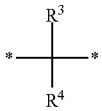

(W2)

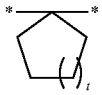

(W3)

In general formulas (W1), (W2), and (W3), $R^3$ represents a hydrogen atom or an alkyl group having a carbon number of at least 1 and no greater than 4. $R^4$ represents an alkyl group having a carbon number of at least 1 and no greater than 4. t represents an integer of at least 1 and no greater than 3. * represents a bond.

(Ar-1)

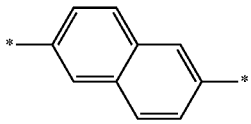

(Ar-2)

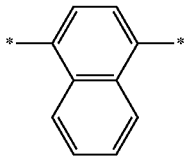

(Ar-3)

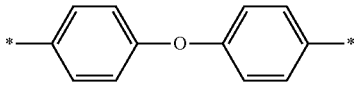

In chemical formulas (Ar-1), (Ar-2), and (Ar-3), * represents a bond.

In the polyarylate resin (PA), multiple repeating units (3) and multiple repeating units (4) are for example arranged in an alternating sequence. In this case, preferably, the amount of the repeating unit (3) and the amount of the repeating unit (4) are substantially the same as each other in the polyarylate resin (PA). Specifically, a ratio (amount of repeating unit (4)/amount of repeating unit (3)) of the amount of the repeating unit (4) to the amount of the repeating unit (3) in the polyarylate resin (PA) is preferably at least 49/51 and no greater than 51/49.

(Repeating Unit (3))

The repeating unit (3) is represented by general formula (3). In general formula (3), $R^1$ and $R^2$ are preferably the same as each other. Preferably, $R^1$ and $R^2$ each represent a methyl group.

In general formula (W1), $R^3$ preferably represents a hydrogen atom. Preferably, $R^4$ represents a methyl group.

In general formula (W2), t preferably represents 2.

The repeating unit (3) is preferably a repeating unit represented by either of chemical formulas (3-1) and (3-2) shown below (also referred to below as repeating units (3-1) and (3-2), respectively).

(3-1)

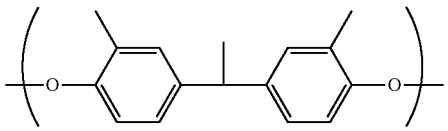

(3-2)

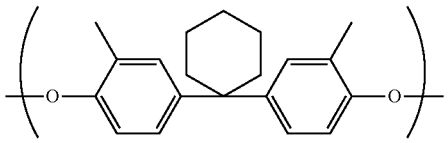

(Repeating Unit (4))

The repeating unit (4) is represented by general formula (4). Examples of the repeating unit (4) include repeating units represented by chemical formulas (4-1), (4-2), and (4-3) shown below (also referred to below as repeating units (4-1), (4-2), and (4-3), respectively).

(4-1)

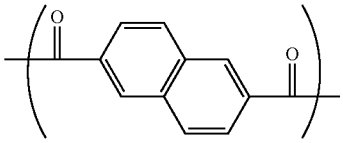

(4-2)

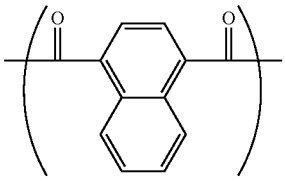

(4-3)

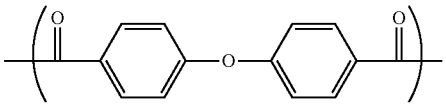

A ratio of a total amount of the repeating units (3) and (4) to a total amount of repeating units included in the polyarylate resin (PA) is preferably at least 70%, more preferably at least 95%, and further preferably 100%.

Preferably, the polyarylate Resin (PA) include:

the repeating units (3-2), (4-1), and (4-3);

the repeating units (3-1), (4-1), and (4-3); or the repeating units (3-2), (4-1), and (4-2).

The polyarylate resin (PA) is preferably a resin represented by any of chemical formulas (PA-1), (PA-2), and (PA-3) shown below (also referred to below as polyarylate resins (PA-1), (PA-2), and (PA-3), respectively).

The polyarylate resin (PA) has a viscosity average molecular weight of preferably at least 20,000 and no greater than 200,000, and more preferably at least 50,000 and no greater than 70,000.

A content percentage of the polyarylate resin (PA) in the photosensitive layer is preferably at least 25% by mass and no greater than 80% by mass, and more preferably at least 40% by mass and no greater than 60% by mass.

No particular limitations are placed on a synthesis method of the polyarylate resin (PA). An example synthesis method of the polyarylate resin (PA) is condensation polymerization of an aromatic diol or a derivative thereof for constituting the repeating unit (3) and an aromatic dicarboxylic acid or a derivative thereof for constituting the repeating unit (4). Specific examples of condensation polymerization include solution polymerization, melt polymerization, and interface polymerization.

An example of the aromatic diol for constituting the repeating unit (3) is an aromatic diol (3a) represented by general formula (3a) shown below. In general formula (3a), $R^1$, $R^2$, and W are the same as defined for $R^1$, $R^2$, and W in general formula (3), respectively. An example of the derivative of such an aromatic diol is aromatic diacetate.

(3a)

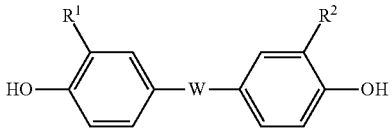

An example of the aromatic dicarboxylic acid for constituting the repeating unit (4) is an aromatic dicarboxylic acid (4a) represented by general formula (4a) shown below. In general formula (4a), Ar is the same as defined for Ar in general formula (4). Examples of the derivative of such an aromatic dicarboxylic acid include aromatic dicarboxylic (PA-1)

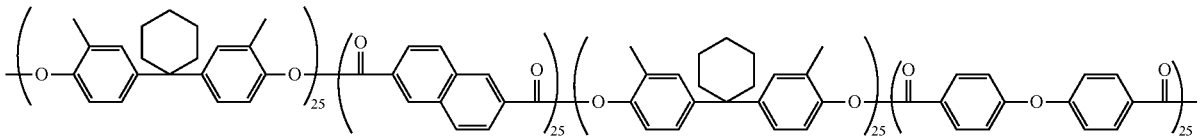

(PA-2)

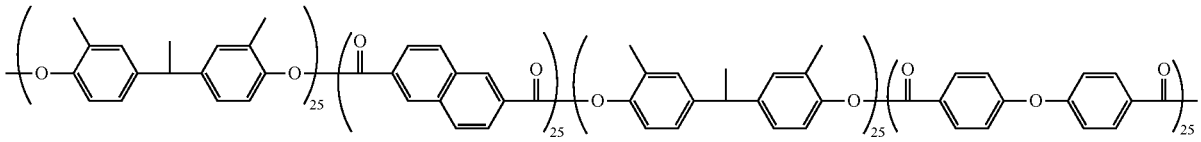

(PA-3)

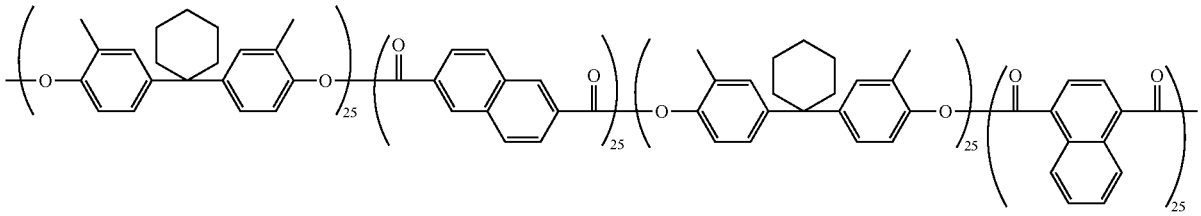

acid dichloride, aromatic dicarboxylic acid dimethyl ester, aromatic dicarboxylic acid diethyl ester, and aromatic dicarboxylic anhydride.

(4)

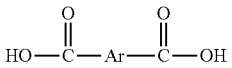

(Additional Binder Resin)

Examples of the additional binder resin include thermoplastic resins, thermosetting resins, and photocurable resins. Examples of the thermoplastic resins include polycarbonate resins, polyarylate resins other than the polyarylate resin (PA), styrene-butadiene copolymers, styrene-acrylonitrile copolymers, styrene-maleic acid copolymers, acrylic acid polymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins other than the polyester resin (PE), polyvinyl acetal resins, and polyether resins. Examples of the thermosetting resins include silicone resins, epoxy resins, phenolic resins, urea resins, and melamine resins. Examples of the photocurable resins include acrylic acid adducts of epoxy compounds, and acrylic acid adducts of urethane compounds.

(Hole Transport Material)

Examples of the hole transport material include triphenylamine derivatives, diamine derivatives (for example, an N,N,N',N'-tetraphenylbenzidine derivative, an N,N,N',N'-tetraphenylphenylenediamine derivative, an N,N,N',N'-tetraphenylnaphtylenediamine derivative, an N,N,N',N'-tetraphenylphenanthrylenediamine derivative, and an di(aminophenylethenyl)benzene derivative), oxadiazole-based compounds (for example, 2,5-di(4-methylaminophenyl)-1,3,4-oxadiazole), styryl-based compounds (for example, 9-(4-diethylaminostyryl)anthracene), carbazole-based compounds (for example, polyvinyl carbazole), organic polysilane compounds, pyrazoline-based compounds (for example, 1-phenyl-3-(p-dimethylaminophenyl) pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds.

An example of the hole transport material is a compound represented by general formula (21) shown below (also referred to below as a hole transport material (21)).

(21)

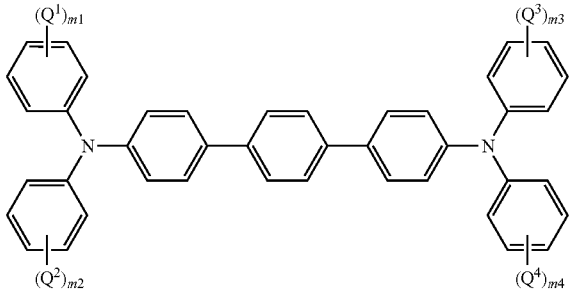

In general formula (21), $Q^1$, $Q^2$, $Q^3$, and $Q^4$ each represent, independently of one another, a phenyl group, an alkyl group having a carbon number of at least 1 and no greater than 8, or an alkoxy group having a carbon number of at least 1 and no greater than 8. Also, m1 to m4 each represent, independently of one another, an integer of no less than 0 and no greater than 2.

In general formula (21), where m1 represents 2, chemical groups $Q^1$ may be the same as or different from one another. Where m2 represents 2, chemical groups $Q^2$ may be the same as or different from one another. Where m3 represents 2, chemical groups $Q^3$ may be the same as or different from one another. Where m4 represents 2, chemical groups $Q^4$ may be the same as or different from one another.

In general formula (21), $Q^1$ and $Q^3$ are preferably the same as each other. Also, $Q^2$ and $Q^4$ are preferably the same as each other. Preferably, $Q^1$ and $Q^2$ are different from each other. Preferably, $Q^3$ and $Q^4$ are different from each other.

In general formula (21), $Q^1$ to $Q^4$ each represent, independently of one another, preferably an alkyl group having a carbon number of at least 1 and no greater than 4 and more preferably a methyl group or an ethyl group.

In general formula (21), preferably, m1 to m4 each represent 1.

An example of the hole transport material (21) is a compound represented by chemical formula (H-1) shown below (also referred to below as a hole transport material (H-1)).

(H-1)

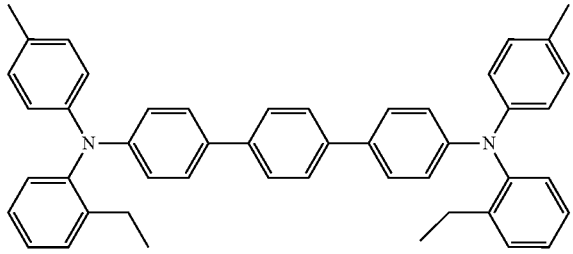

Another example of the hole transport material is a compound represented by general formula (22) shown below (also referred to below as a hole transport material (22)).

(22)

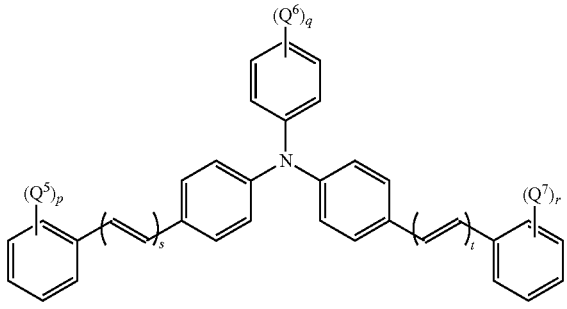

In general formula (22), $Q^5$, $Q^6$, and $Q^7$ each represent, independently of one another, an alkyl group having a carbon number of at least 1 and no greater than 8 or an alkoxy group having a carbon number of at least 1 and no greater than 8. s and t each represent, independently of one another, an integer of at least 1 and no greater than 3. p and r each represent, independently of one another, 0 or 1. q represents an integer of no less than 0 and no greater than 2.

In general formula (22), where q represents 2, chemical groups $Q^6$ may be the same as or different from one another.

In general formula (22), $Q^5$, $Q^6$, and $Q^7$ each represent, independently of one another, preferably an alkyl group having a carbon number of at least 1 and no greater than 8, more preferably an alkyl group having a carbon number of at least 3 and no greater than 6, and further preferably an n-butyl group.

In general formula (22), s and t are preferably the same as each other. Preferably, s and t each represent 2.

In general formula (22), p and r are preferably the same as each other. Preferably, p and r each represent 0. Preferably, q represents 1.

An example of the hole transport material (22) is a compound represented by chemical formula (H-2) shown below (also referred to below as a hole transport material (H-2)).

(H-2)

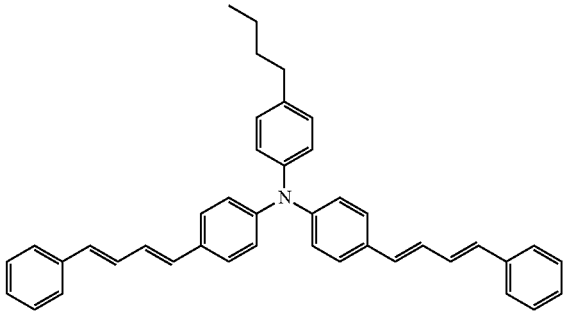

The photosensitive layer preferably contains the hole transport material (21) or (22) as a hole transport material, and more preferably contains the hole transport material (H-1) or (H-2).

A content percentage of a total amount of the hole transport materials (21) and (22) to a total amount of hole transport materials contained in the photosensitive layer is preferably at least 80% by mass, more preferably at least 90% by mass, and further preferably 100% by mass.

The amount of the hole transport material in the photosensitive member is preferably at least 10 parts by mass and no greater than 200 parts by mass relative to 100 parts by mass of the binder resin, and more preferably at least 20 parts by mass and no greater than 100 parts by mass.

(Electron Transport Material)

Examples of the electron transport material include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of the quinone-based compounds include diphenoquinone-based compounds, azoquinone-based compounds, anthraquinone-based compounds, naphthoquinone-based compounds, nitroanthraquinone-based compounds, and dinitroanthraquinone-based compounds.

Examples of the electron transport material include compounds represented by general formulas (11), (12), and (13) shown below (also referred to below as electron transport materials (11), (12), and (13), respectively).

(11)

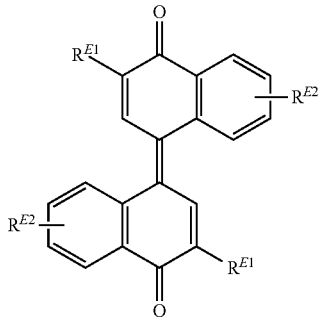

(12)

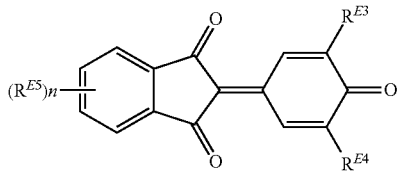

(13)

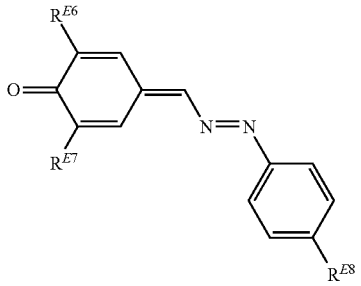

In general formula (11), $R^{E1}$ and $R^{E2}$ each represent, independently of one another, a hydrogen atom, a phenyl group, an alkyl group having a carbon number of at least 1 and no greater than 8, or an alkoxy group having a carbon number of at least 1 and no greater than 8. Two chemical groups $R^{E1}$ may be the same as or different from one another. Two chemical groups $R^{E2}$ may be the same as or different from one another.

Preferably, the two chemical groups $R^{E1}$ are the same as each other. Preferably, the two chemical groups $R^{E2}$ are the same as each other.

In general formula (11), $R^{E1}$ preferably represents an alkyl group having a carbon number of at least 1 and no greater than 8, more preferably represents an alkyl group having a carbon number of at least 3 and no greater than 6, and further preferably represents a 1,1-dimethylpropyl group.

In general formula (11), $R^{E2}$ preferably represents a hydrogen atom.

In general formula (12), $R^{E3}$ and $R^{E4}$ each represent, independently of one another, a hydrogen atom, a phenyl group, an alkyl group having a carbon number of at least 1 and no greater than 8, or an alkoxy group having a carbon number of at least 1 and no greater than 8. $R^{E5}$ represents a phenyl group, an alkyl group having a carbon number of at least 1 and no greater than 8, or an alkoxy group having a carbon number of at least 1 and no greater than 8. n represents an integer of no less than 0 and no greater than 4.

Where n represents an integer of at least 2, chemical groups $R^{E5}$ may be the same as or different from one another.

In general formula (12), $R^{E3}$, $R^{E4}$, and $R^{E5}$ each represent, independently of one another, preferably an alkyl group having a carbon number of at least 1 and no greater than 8, more preferably an alkyl group having a carbon number of at least 3 and no greater than 6, and further preferably a t-butyl group.

In general formula (12), n preferably represents 0.

In general formula (13), $R^{E6}$ and $R^{E7}$ each represent, independently of one another, a hydrogen atom or an alkyl group having a carbon number of at least 1 and no greater than 6. $R^{E8}$ represents a halogen atom, a hydrogen atom, or a nitro group.

In general formula (13), $R^{E6}$ and $R^{E7}$ each represent, independently of one another, preferably an alkyl group having a carbon number of at least 1 and no greater than 6, more preferably an alkyl group having a carbon number of at least 1 and no greater than 4, and further preferably a t-butyl group.

In general formula (13), $R^{E8}$ preferably represents a nitro group.

An example of the electron transport material (11) is a compound represented by chemical formula (E-1) shown below. An example of the electron transport material (12) is a compound represented by chemical formula (E-3) shown below. An example of the electron transport material (13) is a compound represented by chemical formula (E-2) shown below. Hereinafter, the compounds represented by chemical formulas (E-1) to (E-3) shown below may be referred to as electron transport materials (E-1) to (E-3), respectively. The photosensitive layer preferably contains the electron transport material (11), (12), or (13) as an electron transport material and further preferably contains the electron transport material (E-1), (E-2), or (E-3).

(E-1)

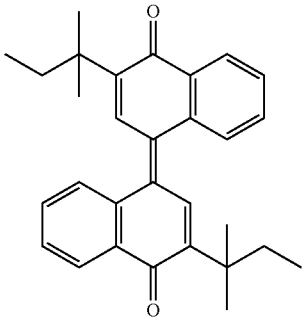

(E-2)

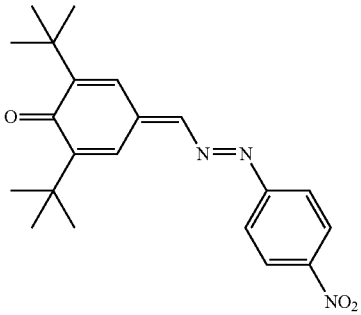

-continued (E-3)

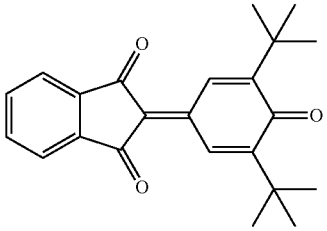

An amount of the electron transport material in the photosensitive layer is preferably at least 20 parts by mass and no greater than 120 parts by mass relative to 100 parts by mass of the binder resin, more preferably at least 20 parts by mass and no greater than 100 parts by mass, further preferably at least 40 parts by mass and no greater than 90 parts by mass, and particularly preferably at least 60 parts by mass and no greater than 90 parts by mass.

(Additive)

Examples of the additive that may be contained in the photosensitive layer include antidegradants (for example, antioxidants, radical scavengers, singlet quenchers, and ultraviolet absorbing agents), softeners, surface modifiers, extenders, thickeners, dispersion stabilizers, waxes, acceptors (for example, electron acceptors), donors, surfactants, plasticizers, sensitizers, and leveling agents. Examples of the antioxidants include hindered phenol (an example is di(tert-butyl)p-cresol), hindered amine, paraphenylenediamine, arylalkane, hydroquinone, spirochromane, spiroindanone, and derivatives of the materials listed above. Other examples of the antioxidants include organosulfur compounds and organophosphorus compounds. An example of the leveling agents is dimethyl silicone oil. An example of the sensitizers is meta-terphenyl.

In a case where the photosensitive layer contains an additive, the amount of the additive is preferably at least 0.1 parts by mass and no greater than 20 parts by mass relative to 100 parts by mass of the binder resin, and more preferably at least 1 part by mass and no greater than 5 parts by mass.

(Combination)

Preferable examples of a combination of the hole transport material, the polyarylate resin (PA), the electron transport material, and the polyester resin (PE) contained in the photosensitive layer are combinations (k-1) to (k-11) listed in Table 1 below. Preferable examples of a combination of the charge generating material, the hole transport material, the polyarylate resin (PA), the electron transport material, and the polyester resin (PE) contained in the photosensitive layer are combinations of Y-form titanyl phthalocyanine with components of any of the combinations (k-1) to (k-11) listed in Table 1.

TABLE 1

| Combination | Hole transport material | Polyarylate resin (PA) | Electron transport material | Polyester resin (PE) |
|---|---|---|---|---|
| k-1 | H-1 | PA-1 | E-1 | PE-a |
| k-2 | H-1 | PA-1 | E-1 | PE-a |
| k-3 | H-1 | PA-1 | E-1 | PE-a |
| k-4 | H-1 | PA-1 | E-1 | PE-a |
| k-5 | H-1 | PA-1 | E-1 | PE-b |
| k-6 | H-1 | PA-1 | E-1 | PE-c |
| k-7 | H-1 | PA-2 | E-1 | PE-a |
| k-8 | H-1 | PA-3 | E-1 | PE-a |

TABLE 1-continued

| Combi-nation | Hole transport material | Polyarylate resin (PA) | Electron transport material | Polyester resin (PE) |
|---|---|---|---|---|
| k-9 | H-2 | PA-1 | E-1 | PE-a |
| k-10 | H-1 | PA-1 | E-2 | PE-a |
| k-11 | H-1 | PA-1 | E-3 | PE-a |

[Intermediate Layer]

The intermediate layer (undercoat layer) for example contains inorganic particles and a resin (resin for intermediate layer use). The intermediate layer may further contain an additive. Inclusion of the intermediate layer in the photosensitive member can be thought to facilitate flow of current generated when the photosensitive member is exposed to light, while also maintaining insulation to a sufficient degree so as to inhibit occurrence of leakage current, thereby suppressing an increase in resistance.

Examples of the inorganic particles include particles of metals (for example, aluminum, iron, and copper), particles of metal oxides (for example, titanium oxide, alumina, zirconium oxide, tin oxide, and zinc oxide), and particles of non-metal oxides (for example, silica).

Respective examples of the resin for intermediate layer use and an additive that may be used in the intermediate layer can include those listed as the examples of the binder resin (the polyarylate resin (PA), the polyester resin (PE), and the additional binder resin) used in the photosensitive layer. However, the resin for intermediate layer use is preferably different from the binder resin contained in the photosensitive layer in terms of easy formation of the intermediate layer and the photosensitive layer.

[Photosensitive Member Production Method]

The following describes an example of a production method of the photosensitive member according to the present disclosure. The production method of the photosensitive member includes a process of applying an application liquid for photosensitive layer formation onto a conductive substrate and a process of drying the application liquid for photosensitive layer formation. The application liquid for photosensitive layer formation contains a charge generating material, a binder resin, a hole transport material, an electron transport material, a component to be added as necessary (for example, an additive), and a solvent. The binder resin includes the polyester resin (PE).

No particular limitations are placed on the solvent contained in the application liquid for photosensitive layer formation other than that the components of the application liquid for photosensitive layer formation should be soluble or dispersible in the solvent. Examples of the solvent include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. In order to improve workability in production of the photosensitive member, a non-halogenated solvent (for example, a solvent that is not a halogenated hydrocarbon) is preferably used as the solvent.

The application liquid for photosensitive layer formation is prepared by mixing the components with the solvent to disperse the components in the solvent. Examples of an apparatus used for mixing and dispersion include a bead mill, a roll mill, a ball mill, an attritor, a paint shaker, and an ultrasonic disperser.

The application liquid for photosensitive layer formation may for example further contain a surfactant in order to improve dispersibility of the components.

No particular limitations are placed on a method by which the application liquid for photosensitive layer formation is applied so long as the method enables uniform application of an application liquid for photosensitive layer formation onto a conductive substrate. Examples of the method by which the application liquid for photosensitive layer formation is applied include blade coating, dip coating, spray coating, spin coating, and bar coating.

Examples of a method that can be used to dry the application liquid for photosensitive layer formation include heat treatment (hot-air drying) using a high-temperature dryer or a reduced pressure dryer. The temperature of the heat treatment is for example 40° C. or higher and 150° C. or lower. The heat treatment is carried out for example for 3 minutes or longer and 120 minutes or shorter.

Note that the production method of the photosensitive member may further include either or both an intermediate layer formation process and a protective layer formation process. Any known methods may be appropriately selected for the intermediate layer formation process and the protective layer formation process.

Second Embodiment: Image Forming Apparatus

An image forming apparatus according to a second embodiment of the present disclosure includes an image bearing member, a charger, a light exposure section, a developing section, and a transfer section. The charger positively charges a surface of the image bearing member. The light exposure section exposes the charged surface of the image bearing member to light to form an electrostatic latent image on the surface of the image bearing member. The developing section develops the electrostatic latent image into a toner image. The transfer section transfers the toner image from the image bearing member to a transfer target. The image bearing member is the photosensitive member according to the first embodiment. The transfer section transfers the toner image from the image bearing member to the transfer target while bringing the transfer target into contact with the surface of the image bearing member.

The photosensitive member included as the image bearing member in the image forming apparatus has high photosensitive layer withstand voltage under high-temperature conditions and excellent sensitivity. A preferable transfer target is a recording medium. That is, the image forming apparatus is preferably an image forming apparatus to which a direct transfer process is adopted. The developing section develops the electrostatic latent image into the toner image preferably while in contact with the surface of the image bearing member. That is, the image forming apparatus is preferably an image forming apparatus of contact development type. The charger may be a contact charger or a non-contact charger. Examples of the contact charger include a charging roller and a charging brush. Examples of the non-contact charger include a corotron charger and a scorotron charger. The charger is preferably a contact charger and more preferably a charging roller.

Figure 4:
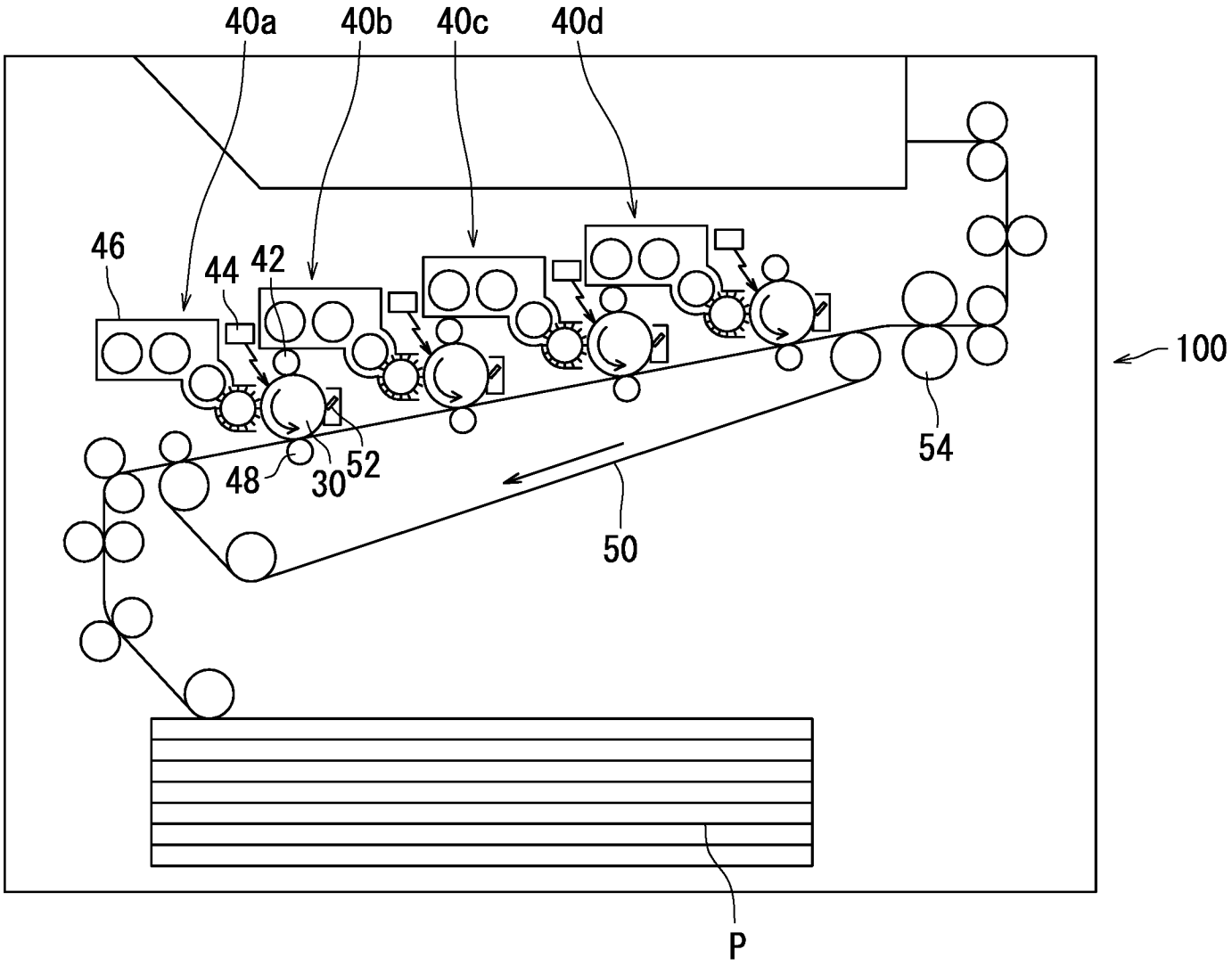
FIG. 4 is a diagram illustrating an example of an image forming apparatus according to a second embodiment of the present disclosure.

The following describes the image forming apparatus using a tandem color image forming apparatus as an example with reference to FIG. 4. The tandem color image forming apparatus is an embodiment of the image forming apparatus.

The image forming apparatus 100 includes a first image forming unit 40*a*, a second image forming unit 40*b*, a third image forming unit 40*c*, a fourth image forming unit 40*d*, a transfer belt 50, and a fixing section 54. Hereinafter, each of the first to fourth image forming units 40*a* to 40*d* may be referred to as an image forming unit 40 where it is not necessary to distinguish among the first to fourth image forming units 40*a* to 40*d*.

The image forming unit 40 illustrated in FIG. 4 includes an image bearing member 30, a charger 42, a light exposure section 44, a developing section 46, a transfer section 48, and a cleaning blade 52. The image bearing member 30 is the photosensitive member according to the first embodiment. The charger 42 charges a surface of the image bearing member 30. The charger 42 has a positive charging polarity. The light exposure section 44 exposes the charged surface of the image bearing member 30 to light to form an electrostatic latent image on the surface of the image bearing member 30. The developing section 46 develops the electrostatic latent image into a toner image. The transfer section 48 transfers the toner image from the image bearing member 30 to a recording medium P while bringing the recording medium P (transfer target) into contact with the surface of the image bearing member 30. The cleaning blade 52 cleans the surface of the image bearing member 30.

The image forming apparatus 100 adopts the direct transfer process. That is, the transfer section 48 transfers the toner image to the recording medium P while bringing the recording medium P into contact with the surface of the image bearing member 30 in the image forming apparatus 100.

The image bearing member 30 is provided at a central position of the image forming unit 40 in a manner to be rotatable in an arrow direction (anticlockwise) in FIG. 4. The charger 42, the light exposure section 44, the developing section 46, the transfer section 48, and the cleaning blade 52 are disposed around the image bearing member 30 in the stated order from upstream in a rotational direction of the image bearing member 30 with the charger 42 as a reference. Note that the image forming unit 40 may further include a static eliminator (not illustrated).

The first to fourth image forming units 40*a* to 40*d* form respective toner images in different colors (for example, four colors of black, cyan, magenta, and yellow) and superimpose the toner images on the recording medium P placed on the transfer belt 50.

The charger 42 is a charging roller. The charging roller charges the surface of the image bearing member 30 while in contact with the surface of the image bearing member 30.

No specific limitations are placed on voltage applied by the charger 42. Examples of the voltage that the charger 42 applies include a direct current voltage, an alternating current voltage, and a superimposed voltage (voltage in which an alternating current voltage is superimposed on a direct current voltage), and a direct current voltage is preferable. The direct current voltage is superior to the alternating current voltage and the superimposed voltage in the following aspects. Application of only the direct current voltage by the charger 42 results in constant voltage application to the image bearing member 30. This can facilitate uniform charging of the surface of the image bearing member 30 to a specific potential. Furthermore, application of only the direct current voltage by the charger 42 tends to decrease an abrasion amount of a photosensitive layer. As a result, application of only the direct current voltage by the charger 42 can achieve formation of images excellent in image quality for a long period of time.

The light exposure section 44 exposes the charged surface of the image bearing member 30 to light. Through light exposure, an electrostatic latent image is formed on the surface of the image bearing member 30. The electrostatic latent image is formed based on image data input to the image forming apparatus 100.

The developing section 46 supplies toner to the surface of the image bearing member 30 and develops the electrostatic latent image into a toner image. The developing section 46 develops the electrostatic latent image into a toner image while in contact with the surface of the image bearing member 30.

The transfer belt 50 conveys the recording medium P to a location between the image bearing member 30 and the transfer section 48. The transfer belt 50 is an endless belt. The transfer belt 50 is provided in a manner to be rotatable in an arrow direction (clockwise) in FIG. 4.

The transfer section 48 transfers the toner image developed by the developing sections 46 from the surface of the image bearing member 30 to the recording medium P. The image bearing member 30 is in contact with the recording medium P in transfer of the toner image from the image bearing member 30 to the recording medium P. The transfer section 48 may for example be a transfer roller.

The fixing section 54 applies either or both heat and pressure to the toner images that are unfixed yet and that have been transferred to the recording medium P by the respective transfer sections 48. The fixing section 54 is for example a heating roller, a pressure roller, or a roller that applies heat and pressure. Application of either or both heat and pressure to the superimposed toner images fixes the toner images to the recording medium P. Thus, an image is formed on the recording medium P.

The image forming apparatus 100 described above is an example of the image forming apparatus according to the second embodiment. The image forming apparatus according to the second embodiment is not limited to the image forming apparatus 100. The image forming apparatus 100 described above is a tandem color image forming apparatus. However, the image forming apparatus according to the second embodiment may for example be a rotary color image forming apparatus or a monochrome image forming apparatus. The monochrome image forming apparatus includes for example only one image forming unit. Furthermore, the image forming apparatus 100 described above is an image forming apparatus that adopts a direct transfer process. However, the image forming apparatus according to the second embodiment may be an image forming apparatus that adopts an intermediate transfer process. In the image forming apparatus that adopts an intermediate transfer process, the transfer target is an intermediate transfer belt.

Third Embodiment: Process Cartridge

A process cartridge according to a third embodiment of the present disclosure includes the photosensitive member of the first embodiment. The photosensitive member included as the image bearing member in the process cartridge has high photosensitive layer withstand voltage under high-temperature conditions and excellent sensitivity.

The following describes an example of the process cartridge according to the third embodiment with further reference to FIG. 4. The process cartridge is a cartridge for image formation. The process cartridge corresponds to each of the first to fourth image forming units 40*a* to 40*d*. The process cartridge includes an image bearing member 30. The image bearing member 30 is the photosensitive member according to the first embodiment. The process cartridge may further include at least one selected from the group consisting of a charger 42, a light exposure section 44, a developing section 46, and a transfer section 48, in addition to the photosensitive member (image beaering member 30). The process cartridge may further include either or both a cleaning blade 52 and a static eliminator (not illustrated). The process cartridge may be designed to be freely attachable to and detachable from the image forming apparatus 100. In the above configuration, the process cartridge is easy to handle. Specifically, the process cartridge including the photosensitive member (image beaering member 30) can be easily and quickly replaced in a situation in which sensitivity or the like of the photosensitive member (image beaering member 30) reduces. The process cartridge according to the third embodiment has been described so far with reference to FIG. 4.

EXAMPLES

The following provides more specific description of the present disclosure through use of Examples. However, the present disclosure is not limited to the scope of Examples.

Note that structure of each of repeating units of resins in Examples was determined through measurement of a $^1$H-NMR spectrum using a proton nuclear magnetic resonance spectrometer (product of JASCO Corporation, 300 MHz). In the measurement of the $^1$H-NMR spectrum, $CDCl_3$ was used as a solvent and tetramethylsilane (TMS) was used as an internal standard sample.

A charge generating material, polyester resins, polyarylate resins, hole transport materials, and electron transport materials described below were prepared as materials for forming photosensitive layers of photosensitive members.

[Charge Generating Material]

Y-form titanyl phthalocyanine represented by chemical formula (CGM-1) described in association with the first embodiment and having a Y-form crystal structure was prepared as a charge generating material.

[Polyester Resin]

The polyester resins (PE-a) to (PE-c) described in association with the first embodiment and a polyester resin (Z) including a repeating unit represented by chemical formula (Z) shown below were each prepared as a polyester resin. Each of the polyester resins was synthesized by the transesterification described in association with the first embodiment.

(Z)

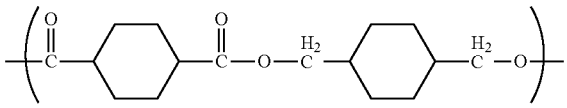

The polyester resins (PE-a) to (PE-c) and (Z) had respective viscosity average molecular weights indicated below.

Polyester resin (PE-a): 22,000

Polyester resin (PE-b): 22,500

Polyester resin (PE-c): 21,300

Polyester resin (Z): 24,200

[Polyarylate Resin]

The polyarylate resins (PA-1) to (PA-3) described in association with the first embodiment were each synthesized as a polyarylate resin by a method described below. The polyarylate resins (PA-1) to (PA-3) had respective viscosity average molecular weights indicated below.

Polyarylate resin (PA-1): 60,800

Polyarylate resin (PA-2): 58,700

Polyarylate resin (PA-3): 61,800

(Synthesis of Polyarylate Resin (PA-1))

A three-necked flask was used as a reaction vessel. The reaction vessel is a 1-L three-necked flask equipped with a thermometer, a three-way cock, and a 200-mL dropping funnel. The reaction vessel was charged with 12.24 g (41.28 mmol) of 1,1-bis(4-hydroxy-3-methylphenyl)cyclohexane, 0.062 g (0.413 mmol) of t-butyl phenol, 3.92 g (98 mmol) of sodium hydroxide, and 0.120 g (0.384 mmol) of benzyltributylammonium chloride. Next, the reaction vessel was purged with argon. Thereafter, 300 mL of water was further added into the reaction vessel. The internal temperature of the reaction vessel was increased to 50° C. The contents of the reaction vessel were stirred for 1 hour while the internal temperature thereof was kept at 50° C. The internal temperature of the reaction vessel was then reduced to 10° C. As a result, an alkaline aqueous solution was obtained.

Separately, 4.10 g (16.2 mmol) of 2,6-naphthalenedicarboxylic acid dichloride and 4.78 g (16.2 mmol) of 4,4'-oxybisbenzoic acid chloride were dissolved in 150 mL of chloroform. As a result, a chloroform solution was obtained.

Subsequently, the chloroform solution was gradually dripped into the alkaline aqueous solution using the dropping funnel over 110 minutes to cause a polymerization reaction to start. The contents of the reaction vessel were stirred for 4 hours while the internal temperature of the reaction vessel was adjusted to 15° C. plus or minus 5° C. to advance the polymerization reaction.

Thereafter, an upper layer (water layer) of the contents of the reaction vessel was removed by decantation, thereby obtaining an organic layer. The resultant organic layer was then added into a 1-L three-necked flask charged with 400 mL of ion exchanged water. Further, 400 mL of chloroform and 2 mL of acetic acid were added into the three-necked flask. The contents of the three-necked flask were stirred at room temperature (25° C.) for 30 minutes. Thereafter, an upper layer (water layer) of the contents of the three-necked flask was removed by decantation, thereby obtaining an organic layer. The resultant organic layer was washed with 1 L of water 5 times using a separatory funnel. As a result, a water-washed organic layer was obtained.

Next, the water-washed organic layer was filtered, thereby obtaining a filtrate. A 3-L beaker was charged with 1 L of methanol. The resultant filtrate was gradually dripped into the beaker, thereby obtaining a precipitate. The precipitate was separated by filtration. The resultant precipitate was vacuum dried at a temperature of 70° C. for 12 hours. Through the above process, the polyarylate resin (PA-1) was obtained.

(Synthesis of Polyarylate Resins (PA-2) and (PA-3))

The polyarylate resins (PA-2) and (PA-3) were synthesized according to the same method as for the polyarylate resin (PA-1) in all aspects other than that the type of the aromatic diol for constituting the repeating unit (3) and the type of the aromatic dicarboxylic acid dichloride for constituting the repeating unit (4) were changed.

[Hole Transport Material]

The hole transport materials (H-1) and (H-2) described in association with the first embodiment were each prepared as a hole transport material.

[Electron Transport Material]

The electron transport materials (E-1) to (E-3) described in association with the first embodiment were each prepared as an electron transport material.

<Photosensitive Member Production Method>

[Production of Photosensitive Member (A-1)]

A container was charged with 2 parts by mass of Y-form titanyl phthalocyanine as a charge generating material, 50 parts by mass of the hole transport material (H-1), 30 parts by mass of the electron transport material (E-1), 100 parts by mass of the polyarylate resin (PA-1), 0.9 parts by mass of the polyester resin (PE-a), and 600 parts by mass of tetrahydrofuran as a solvent. The container contents were mixed for 12 hours using a ball mill in order to disperse the materials in the solvent. Through the above, an application liquid for photosensitive layer formation was obtained. The application liquid for photosensitive layer formation was applied onto a conductive substrate (drum-shaped aluminum support, diameter 30 mm, total length 238.5 mm) by blade coating. The applied application liquid for photosensitive layer formation was dried by hot air blowing at a temperature of 120° C. for 80 minutes. Through the above, a photosensitive layer of a single layer (film thickness 30 μm) was formed on the conductive substrate. A photosensitive member (A-1) was obtained as a result of the process described above.

[Photosensitive Members (A-2) to (A-11) and (B-1) to (B-4)]

Photosensitive members (A-2) to (A-11) and (B-1) to (B-4) were produced according to the same method as for the photosensitive member (A-1) in all aspects other than the following changes. In production of the photosensitive members (A-2) to (A-11) and (B-1) to (B-4), the respective types of the hole transport material, the polyarylate resin, and the electron transport material, and the type and amount of the polyester resin were changed to those listed in Table 2 below.

In Table 2 below, "% by mass" in a column titled "Polyester resin" indicates a percentage by mass of a polyester resin relative to 100% by mass of a corresponding photosensitive layer (total mass of a corresponding charge generating material, a corresponding hole transport material, a corresponding polyarylate resin, a corresponding electron transport material, and a corresponding polyester resin).

TABLE 2

| | Photosensitive member | Hole transport material | Polyarylate resin | Electron transport material | Polyester resin Type | Polyester resin % by mass |
|---|---|---|---|---|---|---|
| Example 1 | A-1 | H-1 | PA-1 | E-1 | PE-a | 0.5 |
| Example 2 | A-2 | H-1 | PA-1 | E-1 | PE-a | 1.3 |
| Example 3 | A-3 | H-1 | PA-1 | E-1 | PE-a | 2.1 |
| Example 4 | A-4 | H-1 | PA-1 | E-1 | PE-a | 6.0 |
| Example 5 | A-5 | H-1 | PA-1 | E-1 | PE-b | 1.3 |
| Example 6 | A-6 | H-1 | PA-1 | E-1 | PE-c | 1.3 |
| Example 7 | A-7 | H-1 | PA-2 | E-1 | PE-a | 1.3 |
| Example 8 | A-8 | H-1 | PA-3 | E-1 | PE-a | 1.3 |
| Example 9 | A-9 | H-2 | PA-1 | E-1 | PE-a | 1.3 |
| Example 10 | A-10 | H-1 | PA-1 | E-2 | PE-a | 1.3 |
| Example 11 | A-11 | H-1 | PA-1 | E-3 | PE-a | 1.3 |
| Comparative Example 1 | B-1 | H-1 | PA-1 | E-1 | — | — |
| Comparative Example 2 | B-2 | H-1 | PA-1 | E-1 | PE-a | 10.0 |
| Comparative Example 3 | B-3 | H-1 | PA-1 | E-1 | PE-a | 0.2 |
| Comparative Example 4 | B-4 | H-1 | PA-1 | E-1 | Z | 1.3 |

<Evaluation>

Withstand voltage, image defects, and sensitivity of each of the photosensitive members (A-1) to (A-11) and (B-1) to (B-4) were evaluated by the following methods. Evaluation results are shown in Table 3 below.

[Withstand Voltage]

Evaluation of withstand voltage (specifically, photosensitive layer withstand voltage under high-temperature conditions) was performed in an environment at a temperature of 23° C. and a relative humidity of 50%. First, a heater was mounted on an inner surface of the conductive substrate (drum-shaped support) of the photosensitive member to keep the temperature of the photosensitive member at 55° C. Next, an electrode in a needle shape was set at a location 1 mm apart from a surface of the photosensitive member and a direct current voltage was applied to the electrode. The voltage applied to the electrode was increased at a constant rate (+300 V/second) until dielectric breakdown occurred in the photosensitive layer. A voltage applied to the electrode at a time when the dielectric breakdown occurred in the photosensitive layer was taken to be an evaluation value for withstand voltage. A photosensitive member can be evaluated as good in withstand voltage if the evaluation value is at least 8 kV and evaluated as poor in withstand voltage if the evaluation value is less than 8 kV.

[Image Defects]

Evaluation of image defects (specifically, dot-shaped image defects) was performed in a high-temperature and high-humidity environment at a temperature of 32.5° C. and a relative humidity of 80%. First, a monochrome printer ("FS-1300D", product of KYOCERA Document Solutions Inc.) was modified to change its development process from a non-contact development process to a contact development process and change its charger from a scorotron charger to a charging roller. The resultant modified printer was used as an evaluation apparatus. Information of the evaluation apparatus was listed below.

Linear velocity: 168 mm/second

Charger: charging roller

Charging polarity of photosensitive member: positive

Development process: contact development process

Transfer process: direct transfer process

In evaluation of image defects, "BLAND PAPER VM-A4 (size A4)" soled by KYOCERA Document Solutions Inc. was used as evaluation paper. A "toner for non-magnetic one-component developer use" produced by KYOCERA Document Solutions Inc. was used as a toner in evaluation of image defects. The toner was loaded in the evaluation apparatus.

An image pattern having a printing rate of 1% was printed on 10,000 sheets of the evaluation paper on a sheet-by-sheet basis at intervals of 15 seconds (generally called intermittent printing) using the evaluation apparatus including the photosensitive member that is a measurement target. The evaluation apparatus after the printing was completed was left to stand for 24 hours. Thereafter, a white image was printed on one sheet of the evaluation paper using the evaluation apparatus. The evaluation paper as a result of the one-sheet printing was visually observed to count the number of dot-shaped image defects. Whether or not image defects were prevented through use of a photosensitive member was determined in accordance with the following criteria.

Image defects were prevented: the number of dot-shaped image defects is no greater than 15.

Image defects were not prevented: the number of dot-shaped image defects is greater than 15.

[Sensitivity]

Evaluation of sensitivity was performed in an environment at a temperature of 23° C. and a relative humidity of 50%. First, a surface of the photosensitive member was charged to +750 V using a drum sensitivity test device (product of Gen-Tech, Inc.). Next, monochromatic light (wavelength 780 mm, half-width 20 nm, optical energy 0.7 $\mu J/cm^2$) was taken out from white light of a halogen lamp using a bandpass filter. The surface of the photosensitive member was irradiated with the taken monochromatic light. The surface potential of the photosensitive member was measured once 50 milliseconds had elapsed after completion of the irradiation. The measured surface potential was taken to be a post-exposure potential [+V]. It is indicated that the smaller the value of the post-exposure potential of a photosensitive member is, the more excellent sensitivity the photosensitive member has. Sensitivity of a photosensitive member was determined as good if the post-exposure potential was no greater than +140 V and as poor if the post-exposure potential was greater than +140 V.

TABLE 3

| | Photosensitive member | Withstand voltage [kV] | Dot-shaped image defects [count] | Post-exposure potential [+V] |
|---|---|---|---|---|
| Example 1 | A-1 | 8.2 | 11 | 111 |
| Example 2 | A-2 | 8.5 | 5 | 114 |
| Example 3 | A-3 | 8.7 | 2 | 118 |
| Example 4 | A-4 | 8.8 | 3 | 135 |
| Example 5 | A-5 | 8.3 | 8 | 115 |
| Example 6 | A-6 | 8.4 | 7 | 114 |
| Example 7 | A-7 | 8.6 | 3 | 112 |
| Example 8 | A-8 | 8.5 | 4 | 112 |
| Example 9 | A-9 | 8.6 | 4 | 100 |
| Example 10 | A-10 | 8.5 | 4 | 141 |
| Example 11 | A-11 | 8.5 | 4 | 136 |
| Comparative Example 1 | B-1 | 7.7 | 28 | 112 |
| Comparative Example 2 | B-2 | 9.2 | 2 | 158 |
| Comparative Example 3 | B-3 | 7.9 | 20 | 113 |
| Comparative Example 4 | B-4 | 7.6 | 31 | 118 |

Each of the photosensitive members (A-1) to (A-11) of Examples 1 to 11 included a conductive substrate and a photosensitive layer of a single layer. The photosensitive layer contained a charge generating material, a binder resin, a hole transport material, and an electron transport material. The binder resin included the polyester resin (PE). The polyester resin (PE) included the repeating unit (1) and the repeating unit (2). A content percentage of the polyester resin (PE) in the photosensitive layer was at least 0.3% by mass and no greater than 7.0% by mass. As shown in Table 3, the photosensitive members (A-1) to (A-11) each had high photosensitive layer withstand voltage under high-temperature conditions and excellent sensitivity. Furthermore, use of any of the photosensitive members (A-1) to (A-11) each having high photosensitive layer withstand voltage under high-temperature conditions was able to prevent dot-shaped image defects in a high-temperature and high-humidity environment.

By contrast, each of the photosensitive members (B-1) to (B-4) of Comparative Examples 1 to 4 did not meet the above preconditions. As a result, the photosensitive members (B-1) to (B-4) were poor in at least one of photosensitive layer withstand voltage under high-temperature conditions and sensitivity.

Specifically, the photosensitive member (B-1) did not contain the polyester resin (PE). The photosensitive member (B-3) contained the polyester resin (PE), an amount of which was insufficient. As a result, each of the photosensitive members (B-1) and (B-3) had low photosensitive layer withstand voltage under high-temperature conditions, resulting in ineffective prevention of dot-shaped image defects in a high-temperature and high-humidity environment.

The photosensitive member (B-2) contained an excessive amount of the polyester resin (PE). As a result, the photosensitive member (B-2) was poor in sensitivity.

The photosensitive member (B-4) contained the polyester resin (Z) that is a polyester resin different from the polyester resin (PE). As a result, the photosensitive member (B-4) had low photosensitive layer withstand voltage under high-temperature conditions, resulting in ineffective prevention of dot-shaped image defects in a high-temperature and high-humidity environment. As is clear from comparison between the photosensitive members (A-1) to (A-11) and the photosensitive member (B-4), it is determined that the polyester (PE) is effective among various polyester resins in order to increase photosensitive layer withstand voltage under high-temperature conditions.

What is claimed is:

1. An electrophotographic photosensitive member comprising a conductive substrate and a photosensitive layer of a single layer, wherein the photosensitive layer contains a charge generating material, a binder resin, a hole transport material, and an electron transport material, the binder resin includes a polyester resin, the polyester resin includes a first repeating unit represented by general formula (1) shown below and a second repeating unit represented by general formula (2) shown below, and a content percentage of the polyester resin in the photosensitive layer is at least 0.3% by mass and no greater than 7.0% by mass,

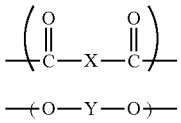

(1)

(2)

where in the general formula (1), X represents a phenylene group optionally substituted by a first substituent, the first substituent being a phenyl group, an alkyl group having a carbon number of at least 1 and no greater than 8, or an alkoxy group having a carbon number of at least 1 and no greater than 8, and in the general formula (2), Y represents a divalent aliphatic hydrocarbon group having a carbon number of at least 1 and no greater than 8 and optionally substituted by a second substituent, the second substituent being a phenyl group or an alkoxy group having a carbon number of at least 1 and no greater than 8.

2. The electrophotographic photosensitive member according to claim 1, wherein the first repeating unit is represented by chemical formula (1-1) or (1-2) shown below, and the second repeating unit is represented by chemical formula (2-1), (2-2), (2-3) or (2-4) shown below:

(1-1)

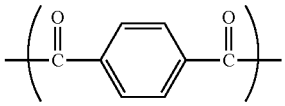

(1-2)

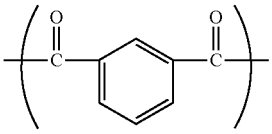

(2-1)

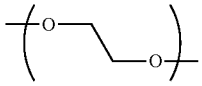

(2-2)

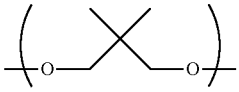

(2-3)

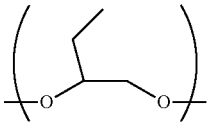

(2-4)

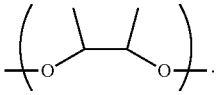

3. The electrophotographic photosensitive member according to claim 2, wherein the polyester resin includes the repeating unit represented by the chemical formula (1-1) and the repeating unit represented by the chemical formula (1-2) each as the first repeating unit, and the repeating unit represented by the chemical formula (2-1) and the repeating unit represented by the chemical formula (2-2) each as the second repeating unit.

4. The electrophotographic photosensitive member according to claim 1, wherein the binder resin further includes a polyarylate resin, and the polyarylate resin includes a third repeating unit represented by general formula (3) shown below and a fourth repeating unit represented by general formula (4) shown below, (3)

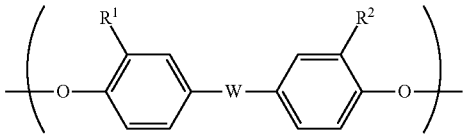

-continued (4)

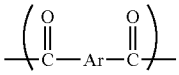

where in the general formula (3), $R^1$ and $R^2$ each represent, independently of one another, a hydrogen atom or a methyl group, and W represents a divalent group represented by general formula (W1), (W2), or (W3) shown below, and in the general formula (4), Ar represents a divalent group represented by chemical formula (Ar-1), (Ar-2), or (Ar-3) shown below, (W1)

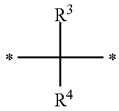

(W2)

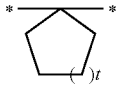

(W3)

where in the general formulas (W1) and (W2) and the chemical formula (W3), $R^3$ represents a hydrogen atom or an alkyl group having a carbon number of at least 1 and no greater than 4, $R^4$ represents an alkyl group having a carbon number of at least 1 and no greater than 4, t represents an integer of at least 1 and no greater than 3, and

* represents a bond, and (Ar-1)

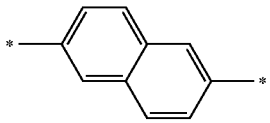

(Ar-2)

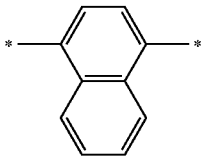

(Ar-3)

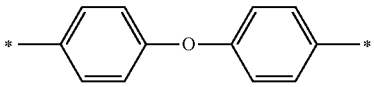

in the chemical formulas (Ar-1), (Ar-2), and (Ar-3), * represents a bond.

5. The electrophotographic photosensitive member according to claim 1, wherein the electron transport material includes a compound represented by general formula (11), (12), or (13) shown below, (11)

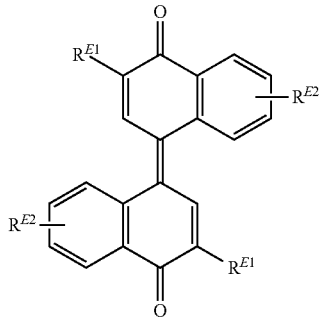

(12)

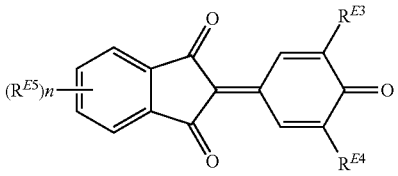

(13)

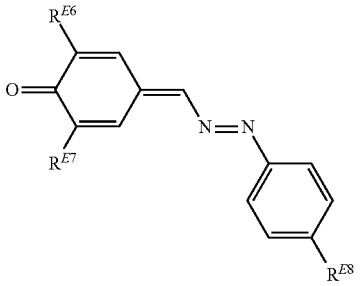

where in the general formula (11), $R^{E1}$ and $R^{E2}$ each represent, independently of one another, a hydrogen atom, a phenyl group, an alkyl group having a carbon number of at least 1 and no greater than 8, or an alkoxy group having a carbon number of at least 1 and no greater than 8, two chemical groups $R^{E1}$ may be the same as or different from one another, and two chemical groups $R^{E2}$ may be the same as or different from one another, in the general formula (12), $R^{E3}$ and $R^{E4}$ each represent, independently of one another, a hydrogen atom, a phenyl group, an alkyl group having a carbon number of at least 1 and no greater than 8, or an alkoxy group having a carbon number of at least 1 and no greater than 8, $R^{E5}$ represents a phenyl group, an alkyl group having a carbon number of at least 1 and no greater than 8, or an alkoxy group having a carbon number of at least 1 and no greater than 8, n represents an integer of no less than 0 and no greater than 4, and where n represents an integer of at least 2, chemical groups $R^{E5}$ may be the same as or different from one another, and in the general formula (13), $R^{E6}$ and $R^{E7}$ each represent, independently of one another, a hydrogen atom or an alkyl group having a carbon number of at least 1 and no greater than 6, and $E^{E8}$ represents a halogen atom, a hydrogen atom, or a nitro group.

6. The electrophotographic photosensitive member according to claim 5, wherein the electron transport material includes a compound represented by chemical formula (E-1) shown below as the compound represented by the chemical formula (11), a compound represented by chemical formula (E-2) shown below as the compound represented by the chemical formula (13), or a compound represented by chemical formula (E-3) shown below as the compound represented by the chemical formula (12), (E-1)

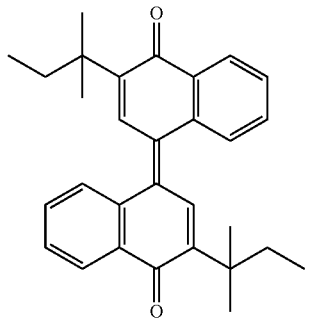

(E-2)

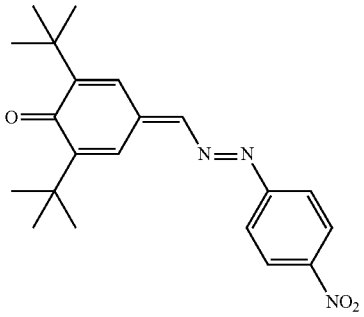

(E-3)

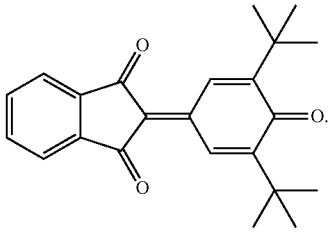

7. The electrophotographic photosensitive member according to claim 1, wherein the hole transport material includes a compound represented by general formula (21) or (22) shown below, (21)

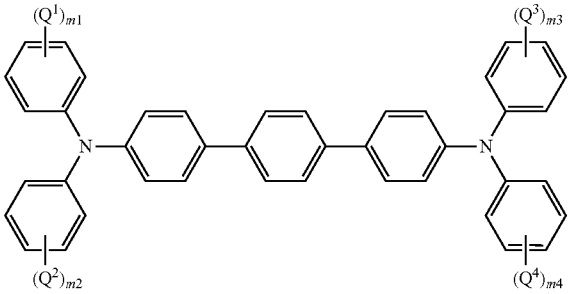

-continued (22)

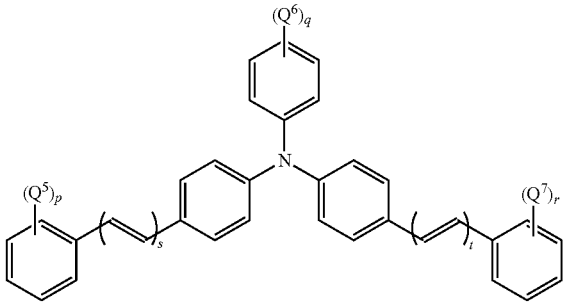

where in the general formula (21), $Q^1$, $Q^2$, $Q^3$, and $Q^4$ each represent, independently of one another, a phenyl group, an alkyl group having a carbon number of at least 1 and no greater than 8, or an alkoxy group having a carbon number of at least 1 and no greater than 8, and m1 to m4 each represent, independently of one another, an integer of no less than 0 and no greater than 2, and in the general formula (22), $Q^5$, $Q^6$, and $Q^7$ each represent, independently of one another, an alkyl group having a carbon number of at least 1 and no greater than 8 or an alkoxy group having a carbon number of at least 1 and no greater than 8, s and t each represent, independently of one another, an integer of at least 1 and no greater than 3, p and r each represent, independently of one another, 0 or 1, and q represents an integer of no less than 0 and no greater than 2.

8. The electrophotographic photosensitive member according to claim 7, wherein the hole transport material includes a compound represented by chemical formula (H-1) shown below as the compound represented by the chemical formula (21) or a compound represented by chemical formula (H-2) shown below as the compound represented by chemical formula (22):

(H-1)

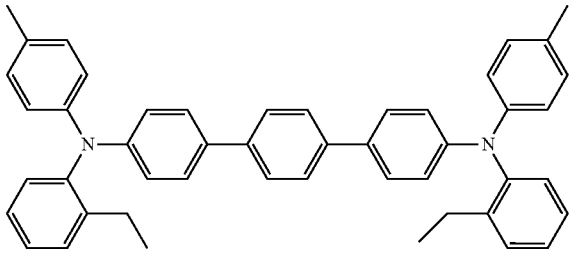

-continued (H-2)

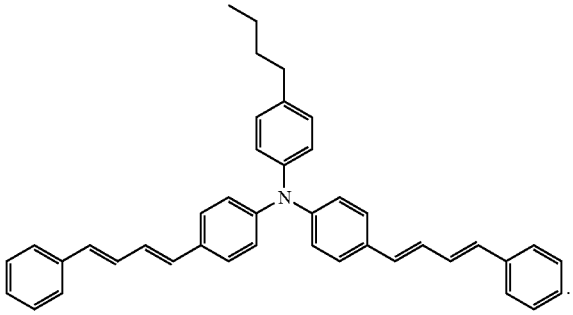

9. A process cartridge comprising the electrophotographic photosensitive member according to claim 1.

10. An image forming apparatus comprising:

an image bearing member;

a charger configured to positively charge a surface of the image bearing member;

a light exposure section configured to expose the charged surface of the image bearing member to light to form an electrostatic latent image on the surface of the image bearing member;

a developing section configured to develop the electrostatic latent image into a toner image; and a transfer section configured to transfer the toner image from the image bearing member to a transfer target, wherein the image bearing member is the electrophotographic photosensitive member according to claim 1, and the transfer section transfers the toner image from the image bearing member to the transfer target while bringing the transfer target into contact with the surface of the image bearing member.

11. The image forming apparatus according to claim 10, wherein the transfer target is a recording medium.

12. The image forming apparatus according to claim 10, wherein the developing section develops the electrostatic latent image into the toner image while in contact with the surface of the image bearing member.

13. The image forming apparatus according to claim 10, wherein the charger is a charging roller.

* * * * *